US006491308B1

(12) United States Patent
Bakx

(10) Patent No.: US 6,491,308 B1
(45) Date of Patent: Dec. 10, 2002

(54) ROLLER SKATE

(75) Inventor: Wilhelmus Stefanus Antonius Maria Bakx, Geleen (NL)

(73) Assignee: Ball-skate AG, Zurich (CH)

( * ) Notice: Subject to any disclaimer, the term of this patent is extended or adjusted under 35 U.S.C. 154(b) by 0 days.

(21) Appl. No.: 09/530,941

(22) PCT Filed: Nov. 9, 1998

(86) PCT No.: PCT/NL98/00649

§ 371 (c)(1),
(2), (4) Date: Jan. 22, 2001

(87) PCT Pub. No.: WO99/24127

PCT Pub. Date: May 20, 1999

(30) Foreign Application Priority Data

Nov. 10, 1997 (NL) ..... 1007508

(51) Int. Cl.[7] ..... A63C 17/24

(52) U.S. Cl. ..... 280/11.226; 280/11.221; 280/843

(58) Field of Search ..... 301/5.3, 5.7; 280/11.19, 280/11.22, 11.221, 11.226, 11.231, 11.27, 11.217, 843; 16/21, 24, 26; 188/29, 25, 4 B, 4 R

(56) References Cited

U.S. PATENT DOCUMENTS 196,024 A * 10/1877 Konz ..... 16/27
597,025 A * 1/1898 Schwartz ..... 280/11.226
904,088 A * 11/1908 Rother ..... 280/11.226
1,224,294 A * 5/1917 Franzen ..... 16/27
1,616,442 A * 2/1927 De Festenburg et al. ... 280/11.226
1,811,532 A * 6/1931 Benetatos ..... 280/11.226
4,076,263 A * 2/1978 Rand ..... 280/843
5,409,265 A * 4/1995 Douglass ..... 280/843
5,690,344 A * 11/1997 Chen ..... 280/11.224
5,716,074 A * 2/1998 Theodorou ..... 280/843
5,720,529 A * 2/1998 Barron ..... 301/5.23
5,829,756 A * 11/1998 Mitchell et al. ..... 280/11.2
5,836,591 A * 11/1998 Roderick et al. ..... 280/11.22
5,961,130 A * 10/1999 Gorza et al. ..... 280/11.2
5,967,552 A * 10/1999 Roderick et al. ..... 280/843
6,065,761 A * 5/2000 Gignoux et al. ..... 280/11.2
6,293,565 B1 * 9/2001 Bouchard et al. ..... 280/11.222

FOREIGN PATENT DOCUMENTS

WO 9205845 * 4/1992

* cited by examiner

*Primary Examiner*—Brian L. Johnson
*Assistant Examiner*—Christopher Bottorff
(74) *Attorney, Agent, or Firm*—Oblon, Spivak, McClelland, Maier & Neustadt, P.C.

(57) ABSTRACT

A roller skate which includes a frame, a structure for fixing the frame to a person's foot, and at least two balls, which are freely rotatably supported by concave rollers. Axes of rotation of the rollers extend in a horizontal direction, transversely to the longitudinal direction of the frame. A roller is located between the two balls which are arranged side by side. The roller bears against both balls during operation.

15 Claims, 5 Drawing Sheets

ROLLER SKATE

BACKGROUND OF THE INVENTION

1. Field of the Invention

The invention relates to a roller skate comprising a frame, means for fixing said frame to a person's foot, and at least two balls, which are freely rotatably supported by concave rollers, whose axes of rotation extend in a direction, transversely to the longitudinal direction of the frame and in use parallel to a rolling surface.

2. Discussion of the Background

With a similar roller skate, which is known from US patent U.S. Pat. No. 4,076,263, each ball is supported by one roller positioned vertically above said ball and two rollers positioned in front of and behind the central roller respectively. Said rollers are concave. The roller skate is supported on the road surface by means of said balls, whereby the presence of the balls leads to an improved road behaviour in comparison with that obtained with conventional axle-supported, barrel-shaped rollers which roll on the road surface. In particular when braking, said balls exhibit better road behaviour, because the balls can also rotate i-n a direction transversely to the direction of transport. The concave rollers thereby exert a force on the balls, as a result of which the balls are gradually brought to a standstill. One drawback of the known roller skate is the fact that, due to the presence of the relatively large rollers on either side of the balls, the number of balls to be mounted under the frame is limited. This has an adverse effect on the rolling behaviour of the roller skate.

SUMMARY OF THE INVENTION

The object of the invention is to provide a roller skate wherein the balls can be positioned a relatively small distance apart.

This objective is accomplished with the roller skate according to the invention in that a roller is present between two balls which are arranged side by side in the longitudinal direction of the frame, which roller bears against both balls during operation.

The diameter of the roller can be selected practically independently of the distance between the two balls which are arranged side by side, so that an optimum freedom of design is obtained.

Another embodiment of the roller skate according to the invention is characterized in that the number of rollers less the number of balls equals 1.

Since the number of rollers is only 1 higher than the number of balls, a relatively simple and inexpensive construction of the roller skate is obtained.

BRIEF DESCRIPTION OF THE DRAWINGS

The invention will be explained in more detail hereafter with reference to the drawings, wherein.

DESCRIPTION OF THE PREFERRED EMBODIMENTS

Corresponding parts are indicated by the same numerals in the figures.

Figure 1:
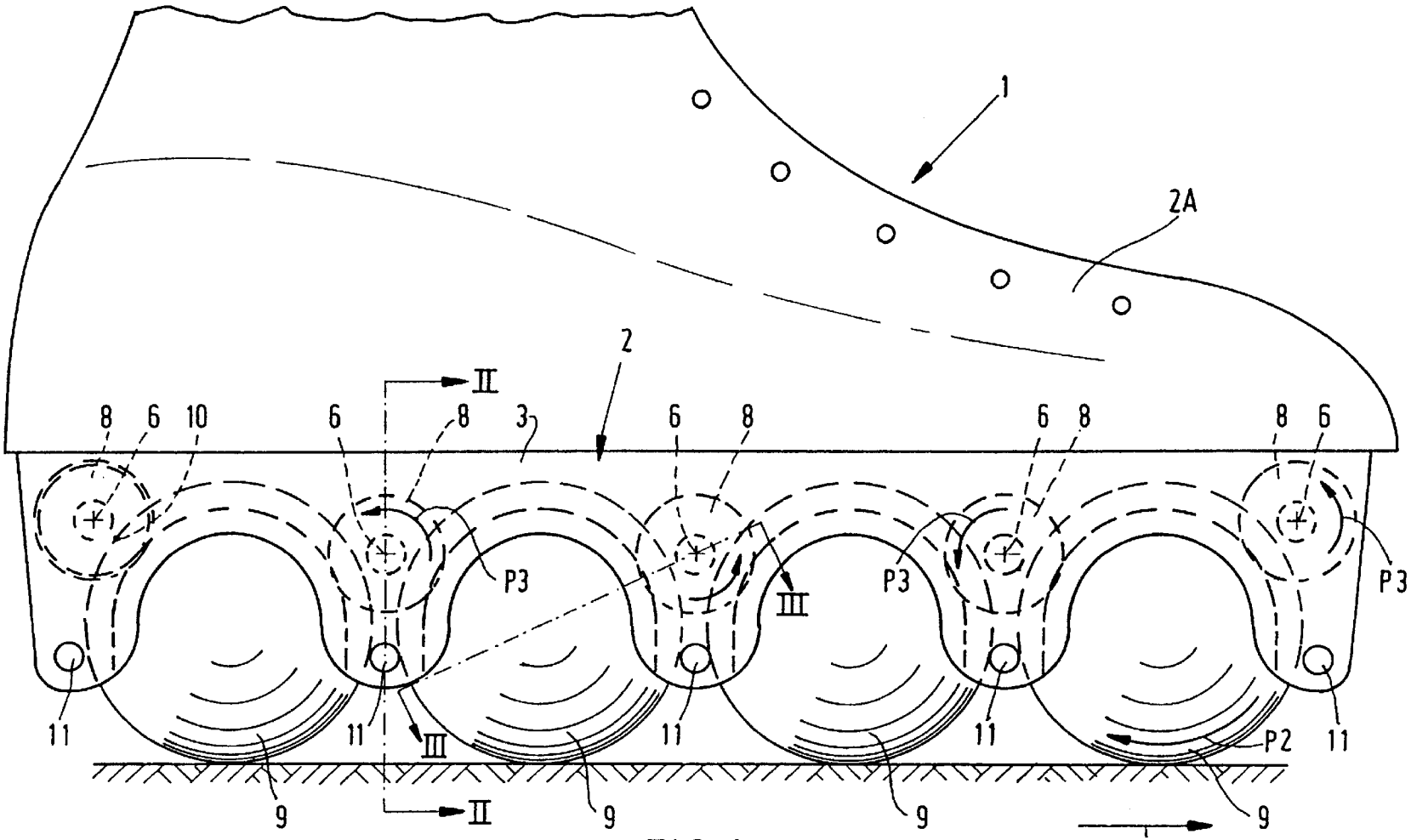
FIG. 1 is a side view of a first embodiment of a roller skate according to the invention.
Figure 2:
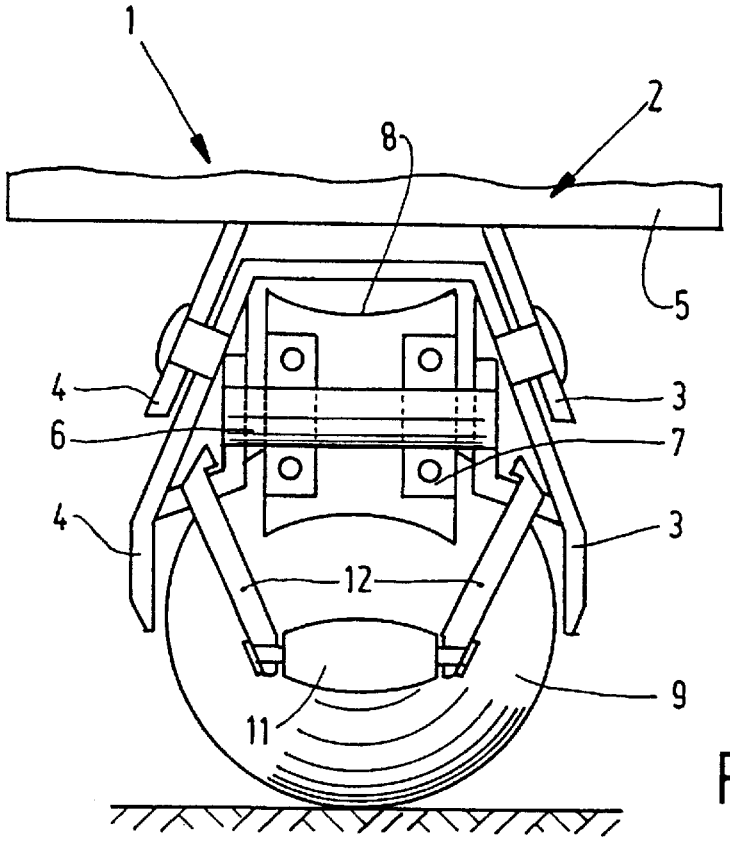
FIG. 2 is a cross-sectional view of the roller skate shown in FIG. 1, in the direction indicated by arrows II—II.
Figure 3:
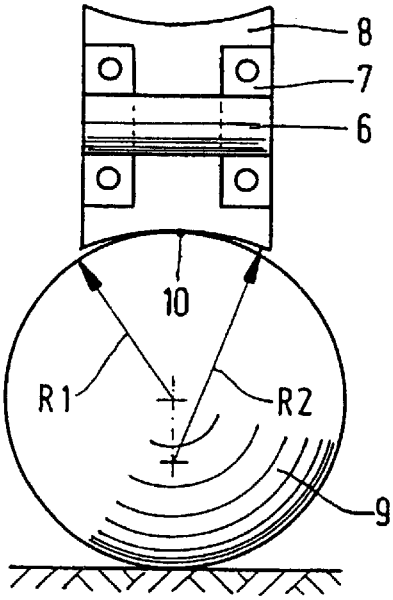
FIG. 3 is a cross-sectional view of the roller skate shown in FIG. 1, in the direction indicated by arrows III—III.

FIG. 1 is a side view of a roller skate 1 according to the invention, which comprises a frame 2 and a shoe 3, which is fixed to frame 2. Frame 2 is provided with two flanges 3, 4 extending in the longitudinal direction of frame 2, which are connected at an angle to a baseplate 5 of the frame. Axles 6 are present between flanges 3, 4, which axles extend horizontally and transversely to the plane of FIG. 1. Concave rollers 8 are mounted on axles 6 via a pair of ball-bearings 7. Balls 9 are positioned between said rollers 8, with a roller 8 present between two balls 9 arranged side by side bearing against both balls 9. Ball 9 has a radius RI, whilst the radius of curvature of concave rollers 8 is R2. Preferably, the radius of curvature R2 of concave rollers 8 is larger than the radius of curvature R1 of ball 9, so that ball 9 only bears against roller 8 via a point contact 10. Frame 2 is furthermore provided with a number of barrel-shaped rollers 11, which extend parallel to axles 6 and which are rotatably supported in arms 12 connected to flanges 3, 4. Barrel-shaped rollers 11 are present on a different side of an axis of balls 9 than rollers 8. The distance between two rollers 11 arranged side by side is smaller than the diameter of balls 9. Thus, rollers 11 prevent balls 9 from falling out of frame 2. As is clearly shown in FIG. 1, balls 9 are spaced a relatively small distance apart, which makes it possible to use a relatively large number of balls 9. Because a single roller 8 is provided between two balls 9 arranged side by side, which roller bears against both balls 9, it is possible to select a relatively large diameter for roller 8.

The operation of roller skate 1 is as follows. Roller skate 1 is moved by the user in the direction indicated by arrow PI, whereby balls 9 rotate in a direction indicated by arrow P2. Since balls 9 are in contact with rollers 8, rollers 8 will be rotated in the direction indicated by arrow P3. As a result of the relatively large diameter of rollers 8, the number of revolutions of rollers 8 will be relatively limited thereby. If a user of roller skate 1 wishes to brake, he will move his foot in a direction transversely to the drawing, thus causing balls 9 to rotate in that direction as well. Rollers 8 will come to a standstill, and rollers 8 will exert a friction force on balls 9, as a result of which balls 9 will gradually be brought to a standstill.

Figure 4:
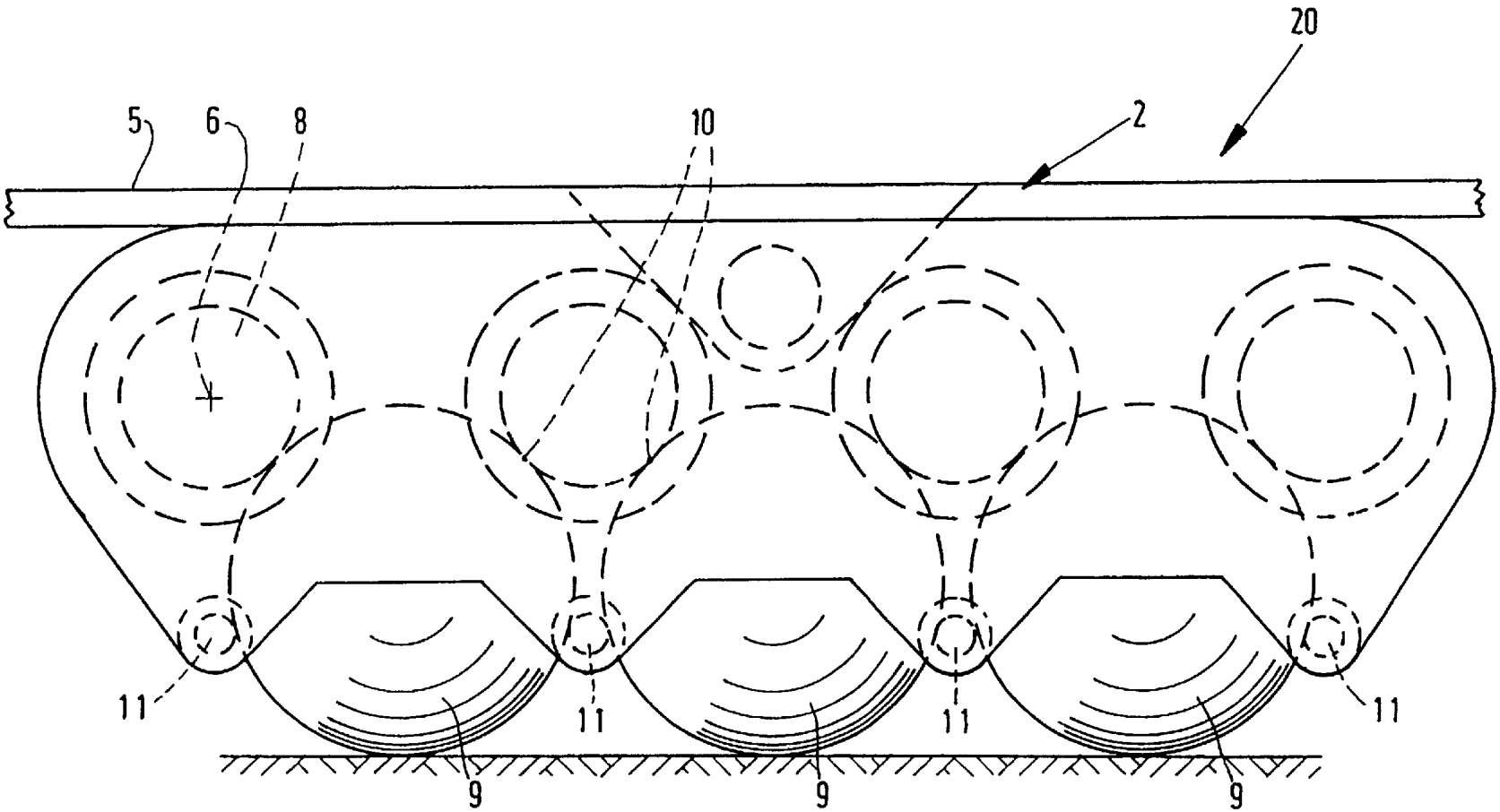
FIG. 4 is a side view of a second embodiment of a roller skate according to the invention.

FIG. 4 shows in side view a second embodiment of a roller skate 20 according to the invention, which is provided with three balls 9 arranged side by side, which are supported by four rollers 8 arranged beside and between balls 9. On a side remote from rollers 8, balls 9 are prevented from falling out of frame 2 by barrel-shaped rollers 11. Preferably, rollers 11 are detachably connected to frame 2, so that the balls 9 surrounding a roller 11 can be removed from the frame, and subsequently be replaced, by removing said roller 11.

Figure 5:
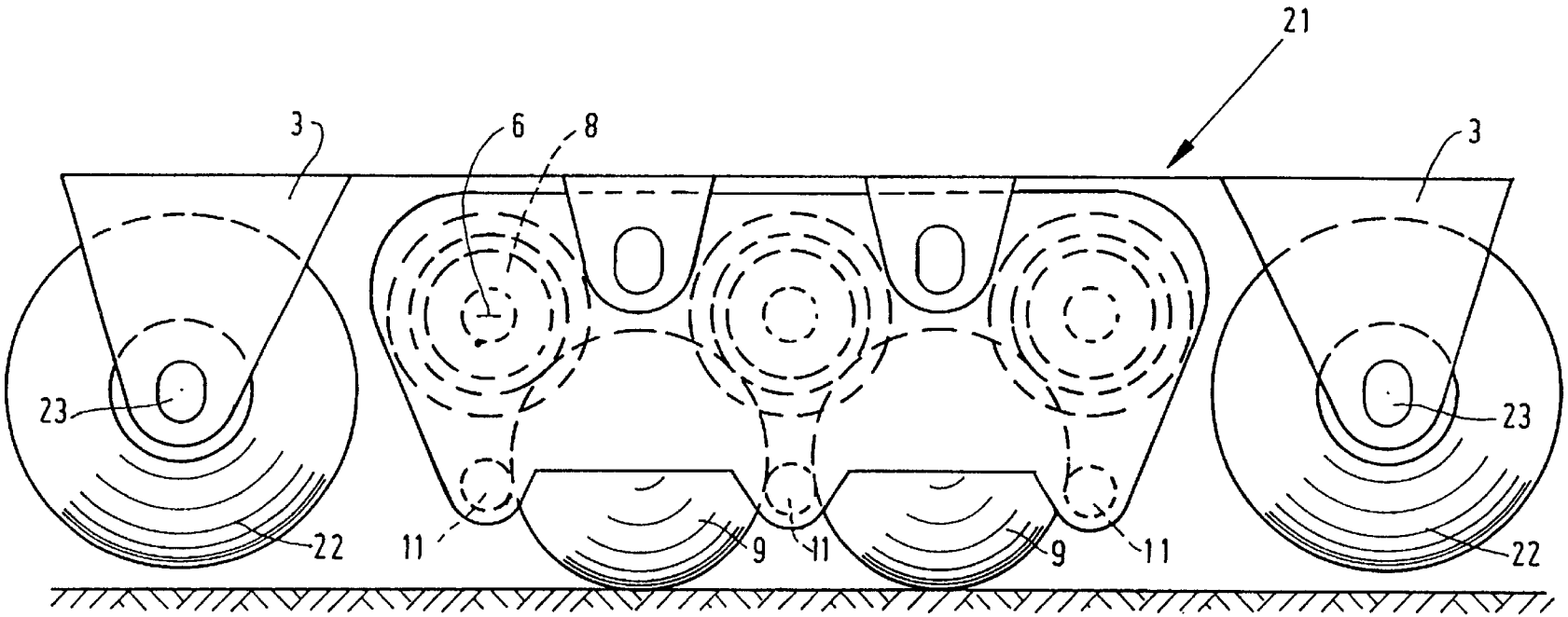
FIG. 5 is a side view of a third embodiment of a roller skate according to the invention.

FIG. 5 shows in side view a third embodiment of a roller skate 21 according to the invention, which is provided with two balls 9, which are supported by three rollers 8. At the front side and the rear side, roller skate 21 is provided with conventional rollers 22, which are rotatably connected to frame 2 by means of horizontally extending axles 23.

Rollers 22 are positioned some distance above the ground surface, whereby one of the rollers 22 comes into contact with the ground surface by tilting the roller skate forward or backward.

Figure 6:
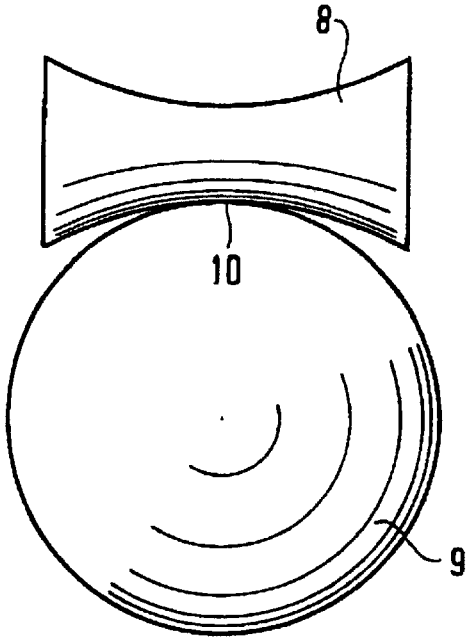
FIGS. 6–9 show several concave rollers abutting against balls.

FIG. 6 shows a concave roller 8, which abuts against ball 9 at a single location or point contact 10.

Figure 7:
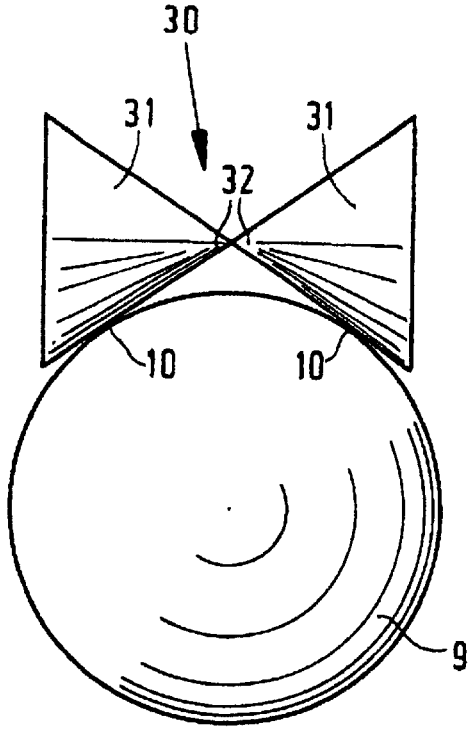

FIG. 7 shows a roller 30, which comprises two cone-shaped elements 31, which are connected near cone tips 32. Concave roller 30 abuts against ball 9 near two locations 10. Locations 10 are positioned symmetrically with respect to the centre of ball 9 and roller 30. Since ball 9 makes contact with roller 30 at two locations 10, the force being exerted at a location 10 has been halved in comparison with the situation which is shown in FIG. 6, wherein the force of ball 9 is transmitted to roller 8 via a single location 10 or point contact only.

Figure 8:
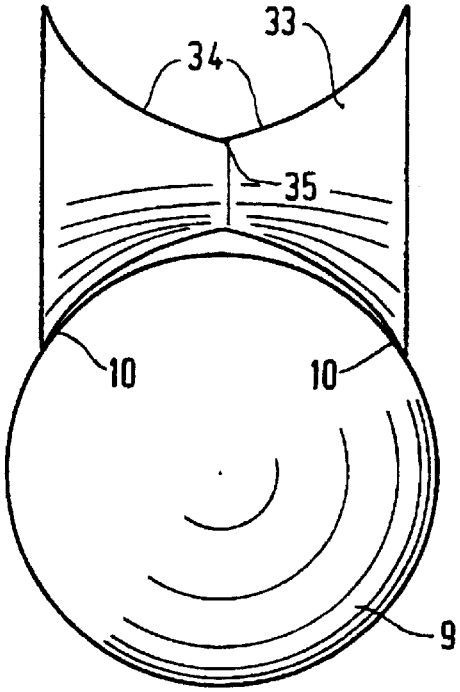

FIG. 8 shows another embodiment of a roller 33, which abuts against ball 9 at two locations 10. Roller 33 comprises two concave surfaces 34, which touch each other near the centre 35.

Figure 9:
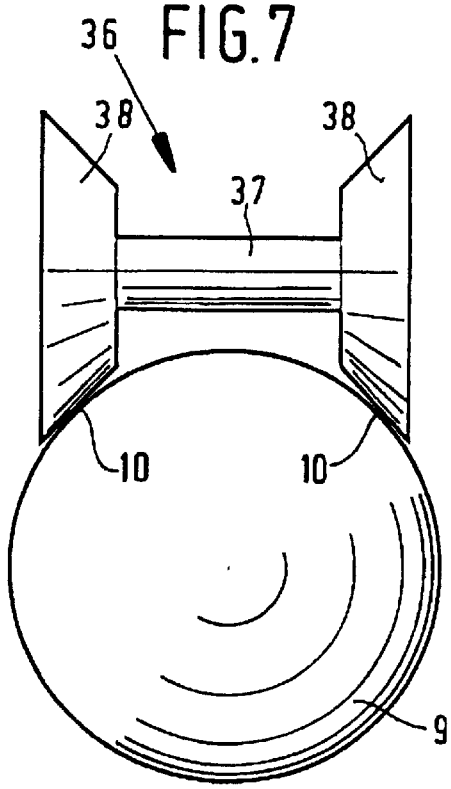

FIG. 9 shows another embodiment of a concave roller 36, which comprises a bridge portion 37, which is connected to cone-shaped segments 38 at both ends. Each cone-shaped segment 38 abuts against ball 9 via a point contact at location 10.

The diameter of the balls preferably ranges between 58 mm for stunt riders and 82 mm for competition riders. The larger the ball, the greater the speed that can be obtained with roller skate 1.

What is claimed is:

1. A roller skate comprising a frame, means for fixing said frame to a person's foot, and at least two balls, which are supported against translation in the frame by concave rollers supported in the frame such that the balls are free to rotate in any direction, axes of rotation of the concave rollers extending in a horizontal direction, transversely to the longitudinal direction of the frame and in use parallel to a rolling surface, wherein a roller is present between two balls which are arranged side by side, which roller bears against both balls during operation.

2. A roller skate according to claim 1, wherein a spacing between the two balls arranged side by side is smaller than a diameter of the roller at a point of contact with the ball or balls.

3. A roller skate according to claim 1, wherein a radius of curvature of a concave portion of the concave roller is larger than a radius of curvature of the balls.

4. A roller skate according to claim 1, wherein the ball abuts against the roller at two locations, which locations are positioned symmetrically with respect to the roller.

5. A roller skate according to claim 2, wherein the frame is provided with at least one detachable ball support on a side of the balls remote from the rollers.

6. A roller skate according to claim 1, wherein the number of rollers less the number of balls equals 1.

7. A roller skate according to claim 2, wherein a radius of curvature of a concave portion of the concave roller is larger than a radius of curvature of the balls.

8. A roller skate according to claim 2, wherein the ball abuts against the roller at two locations, which locations are positioned symmetrically with respect to the roller.

9. A roller skate according to claim 2, wherein the frame is provided with at least one detachable ball support on a side of the balls remote from the rollers.

10. A roller skate according to claim 3, wherein the frame is provided with at least one detachable ball support on a side of the balls remote from the rollers.

11. A roller skate according to claim 4, wherein the frame is provided with at least one detachable ball support on a side of the balls remote from the rollers.

12. A roller skate according to claim 2, wherein the number of rollers less the number of balls equals 1.

13. A roller skate according to claim 3, wherein the number of rollers less the number of balls equals 1.

14. A roller skate according to claim 4, wherein the number of rollers less the number of balls equals 1.

15. A roller skate according to claim 5, wherein the number of rollers less the number of balls equals 1.

* * * * *